US005917874A

United States Patent [19]

Schlyer et al.

[11] Patent Number: 5,917,874

[45] Date of Patent: Jun. 29, 1999

[54] ACCELERATOR TARGET

[75] Inventors: David J. Schlyer, Bellport; Richard A. Ferrieri, Patchogue; Conrad Koehler, Miller Place, all of N.Y.

[73] Assignee: Brookhaven Science Associates, Upton, N.Y.

[21] Appl. No.: 09/009,834

[22] Filed: Jan. 20, 1998

[51] Int. Cl.[6] ..... G21G 1/10

[52] U.S. Cl. ..... 376/194; 376/190

[58] Field of Search ..... 376/190, 191, 376/194, 195, 196, 198, 199, 202, 151; 250/492.1, 493.1, 505.1

[56] References Cited

U.S. PATENT DOCUMENTS

| | | | |
|---|---|---|---|
| 2,504,585 | 4/1950 | Reid . | |
| 2,933,422 | 4/1960 | Lawrence et al. . | |
| 3,675,072 | 7/1972 | Hahn et al. | 315/111 |
| 3,694,313 | 9/1972 | Blue et al. | 376/198 |
| 3,924,137 | 12/1975 | Alger | 376/151 |
| 3,955,093 | 5/1976 | Quinby | 250/493 |
| 4,088,532 | 5/1978 | Blue | 196/11 |
| 4,192,998 | 3/1980 | Azam | 376/190 |
| 4,360,495 | 11/1982 | Bauer | 376/151 |
| 4,582,667 | 4/1986 | Bauer | 376/192 |
| 4,666,651 | 5/1987 | Barjon et al. | 376/108 |
| 4,681,727 | 7/1987 | Mirzadeh et al. | 376/198 |
| 4,752,432 | 6/1988 | Bida et al. | 376/195 |
| 4,945,251 | 7/1990 | Bechtold et al. | 250/492.1 |
| 5,037,602 | 8/1991 | Dabiri et al. | 376/198 |
| 5,345,477 | 9/1994 | Wieland et al. | 376/195 |
| 5,519,738 | 5/1996 | Hirose et al. | 376/195 |
| 5,583,896 | 12/1996 | Hirose et al. | 376/195 |
| 5,586,153 | 12/1996 | Alvord | 376/196 |
| 5,598,449 | 1/1997 | Yamazaki et al. | 376/195 |

OTHER PUBLICATIONS

Schlyer et al, "Correlation of Hole Size in Support Windows with Calculated Yield Strengths," Proceedings of Sixth Workshop on Targetry and Target Chemistry,Canada,17–19 Aug. 1995,pp.:142&143.

Lepera et al, "Experiences with a New High Pressure Water Target for the Production of [$^{13}$N]Ammonia, "Proceedings of the Fifth Workshop on Targetry and Target Chemistry, NY, 19–23 Sep. 1993, pp.: 171–175.

Hughey et al, "Design Considerations for Foil Windows for PET Radioisotope Targets," Proceedings of the Fourth Workshop on Target and Target Chemistry, Switerland, 9–12 Sep. 1991, 8 pages.

Schulze et al, "Thin Windows for an 8 MeV Helium–3 PET RFQ Accelerator Target," Proceedings of the Fourth Workshop on Target and Target Chemistry, Switerland, 9–12 Sep. 1991, 5 pages.

*Primary Examiner*—Charles T. Jordan
*Assistant Examiner*—Matthew J. Lattig
*Attorney, Agent, or Firm*—Margaret C. Bogosian

[57] ABSTRACT

A target includes a body having a depression in a front side for holding a sample for irradiation by a particle beam to produce a radioisotope. Cooling fins are disposed on a backside of the body opposite the depression. A foil is joined to the body front side to cover the depression and sample therein. A perforate grid is joined to the body atop the foil for supporting the foil and for transmitting the particle beam therethrough. A coolant is circulated over the fins to cool the body during the particle beam irradiation of the sample in the depression.

10 Claims, 3 Drawing Sheets

ACCELERATOR TARGET

This invention was made with Government support under Contract No. DE-AC02-98CH10886 awarded by the U.S. Department of Energy. The Government has certain rights in this invention.

BACKGROUND OF THE INVENTION

The present invention relates generally to the production of radioisotopes, and, more specifically, to a target for irradiation of a sample by an accelerated particle beam to produce the radioisotope.

A radioisotope may be produced by irradiating a material sample with a particle beam produced in an accelerator based on various nuclear reactions. A typical medical application is Positron Emission Tomography (PET). The nuclear medicine PET procedure is used for imaging and measuring physiologic processes within the human body. A radiopharmaceutical is labeled with a radioactive isotope and is suitably administered to a patient. The radioisotope decays inside the patient through the emission of positrons. The positrons are annihilated upon encountering electrons which produce oppositely directed gamma rays. A PET scanner includes detectors surrounding the patient which detect the paths of the gamma rays. This data is suitably analyzed to map the present of the radioisotopes in the patient for diagnostic purposes.

A typical radioisotope is Fluorine-18 ($^{18}F$) which has a very short half-life. Accordingly, the radioisotope must be produced immediately before being administered to the patient which presents a substantial problem since complex and expensive equipment is required to produce the radioisotope. Expensive particle beam accelerators are used to emit a particle beam to react with a material sample for producing the radioisotope. A high energy 12 MeV proton beam is typically produced in a cyclotron and steered to the target sample for producing a nuclear reaction to generate the desired radioisotope. The high energy proton beam requires a high power accelerator for its production although the resulting proton beam has relatively low beam current of about 10–20 microamps.

The desired sample material, in liquid, gas, or solid form, is placed in a suitably configured target for undergoing irradiation. The target may include an entrance window foil of aluminum which covers the sample and allows the high energy, low current proton beam to pass into the sample without substantial energy loss. The particle beam hits the sample in the target which must be cooled for maintaining integrity of the target and the foil window.

In order to reduce the cost of producing radioisotopes, the use of low power accelerators producing low energy particle beams is being explored. For example, a low energy 8 MeV proton beam is less expensive to produce. However, a relatively large beam current of about 100–150 microamps is required therewith for obtaining a suitably high power density in the target for producing the radioisotope. Low energy proton beams are quickly degraded by typical entrance window foils, and substantial heat energy must still be dissipated from the target.

Accordingly, it is desired to provide an improved target specifically configured for use with low energy, high current particle beams for effectively producing radioisotopes.

SUMMARY OF THE INVENTION

A target includes a body having a depression in a front side for holding a sample for irradiation by a particle beam to produce a radioisotope. Cooling fins are disposed on a backside of the body opposite the depression. A foil is joined to the body front side to cover the depression and sample therein. A perforate grid is joined to the body atop the foil for supporting the foil and for transmitting the particle beam therethrough. A coolant is circulated over the fins to cool the body during the particle beam irradiation of the sample in the depression.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
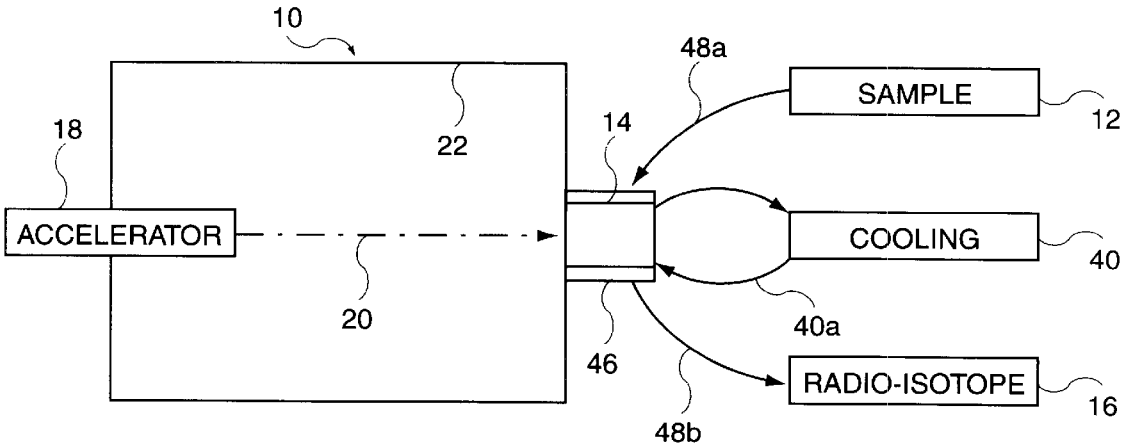
FIG. 1 is a schematic representation of a system including a particle beam accelerator for irradiating a target in accordance with an exemplary embodiment of the present invention.

Illustrated schematically in FIG. 1 is a system or apparatus 10 for irradiating a sample 12 inside a target 14 to produce a radioisotope 16. In an exemplary embodiment, the radioisotope is Fluorine-18 ($^{18}F$) for use in Positron Emission Tomography. The sample 12 may have any form such as a liquid, gas, or solid, and material composition for producing the desired radioisotope. In the preferred embodiment, the sample 12 is water enriched with Oxygen-18 ($^{18}O$).

A accelerator 18, which may be a conventional cyclotron, is used for producing a particle beam 20 in the exemplary form of a proton beam having low beam energy of about 8 MeV and high beam current of about 100–150 microamps. The proton beam 20 is directed through an evacuated housing 22 to irradiate the sample 12 inside the target 14 for producing the radioisotope Fluorine-18 in accordance with the conventional nuclear reaction therefor.

Figure 2:
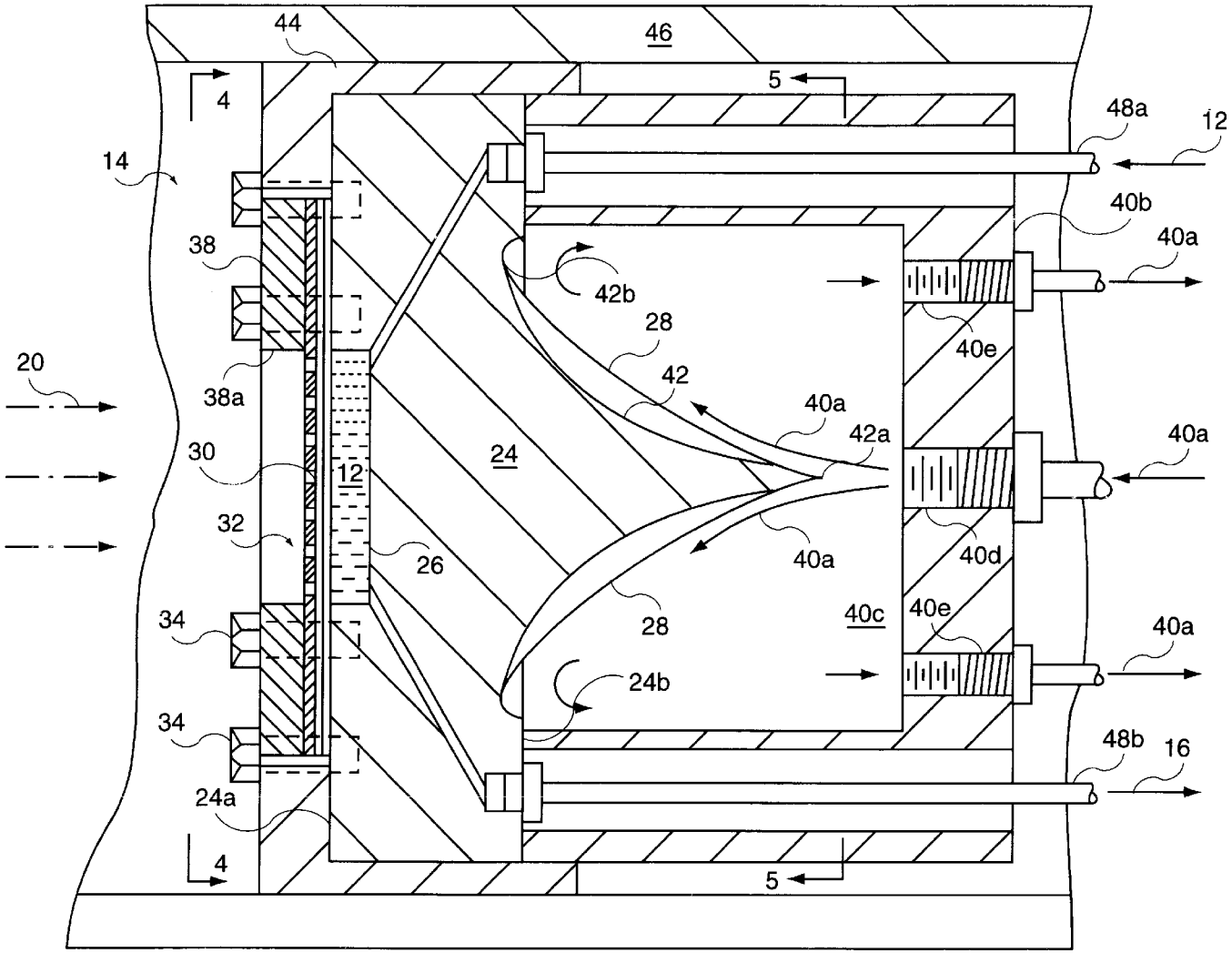
FIG. 2 is a partly sectional, elevational view of the target illustrated in FIG. 1 showing a depression on a front side for holding the sample and cooling fins on the backside for cooling the body in accordance with an exemplary embodiment of the present invention.

The target 14 is illustrated in more detail in FIG. 2 in accordance with a preferred embodiment of the present invention. The target includes a metal body 24 in the form of a disk or plate preferably made of silver, titanium, or copper for their high heat conducting capabilities and chemical inertness. The body 24 includes a front side 24*a* in which is centrally formed a shallow depression or reservoir 26 which receives and holds the sample 12. The body 24 also includes an opposite backside 24*b* including a plurality of integral cooling fins 28 positioned behind the depression 26 for removing heat from the body.

An entrance foil or window 30 is sealingly joined to the body front side to cover or close the depression 26 and secure the sample 12 therein. The foil 30 is preferably extremely thin, and may be formed of aluminum with a thickness of about six microns. Since the particle beam 20 has low energy, the foil 30 is made as thin as feasible for reducing the energy loss of the beam 20 as it passes therethrough to the sample 12 inside the depression 26. Since the foil 30 is extremely thin it is also fragile and not self-supporting as compared to relatively thick aluminum foils conventionally known. The high beam current and power density due to the particle beam 20 during operation generates significant heat in the sample 12 which becomes pressurized beyond the capabilities of the thin foil 30 to withstand by itself.

Accordingly, a perforate support grid 32 in the form of a plate or disk is fixedly joined by a plurality of fastening bolts 34 to the front side of the body 24 atop the foil 30 for supporting the foil against the pressure developed in the sample 12 during operation. The perforate grid 32 also allows the particle beam 20 to pass or be transmitted therethrough and in turn through the foil 30 to irradiate the sample 12 in the depression 26.

Figure 3:
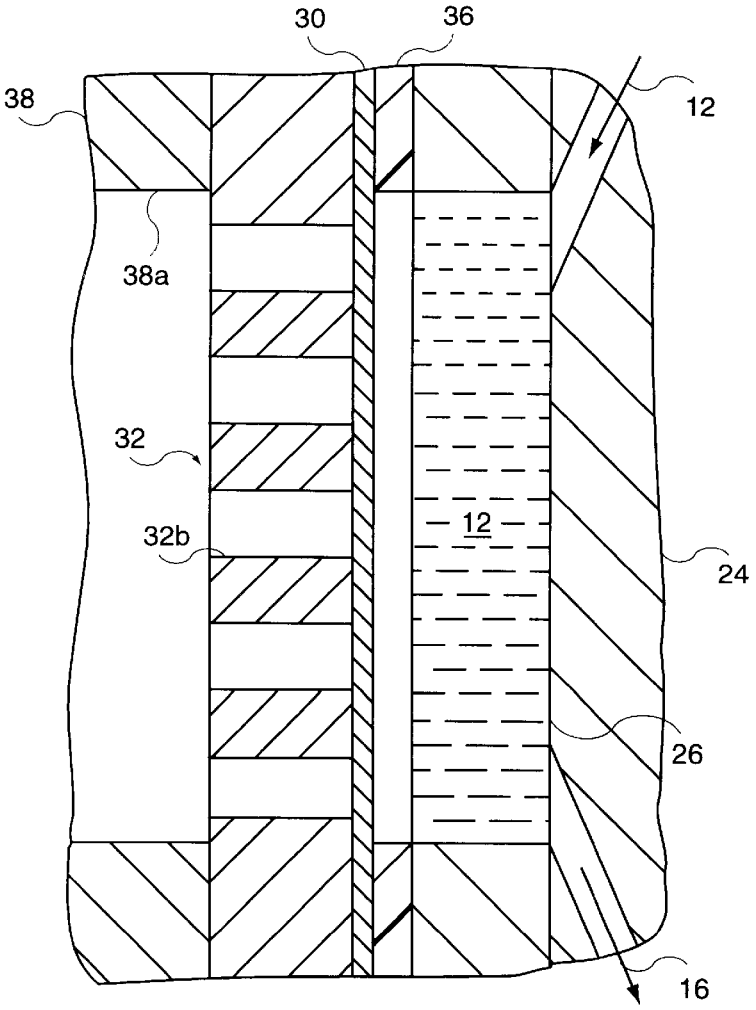
FIG. 3 is an enlarged sectional view of the sample holding depression of the body illustrated in FIG. 2 including a foil window and a supporting grid therefor.
Figure 4:
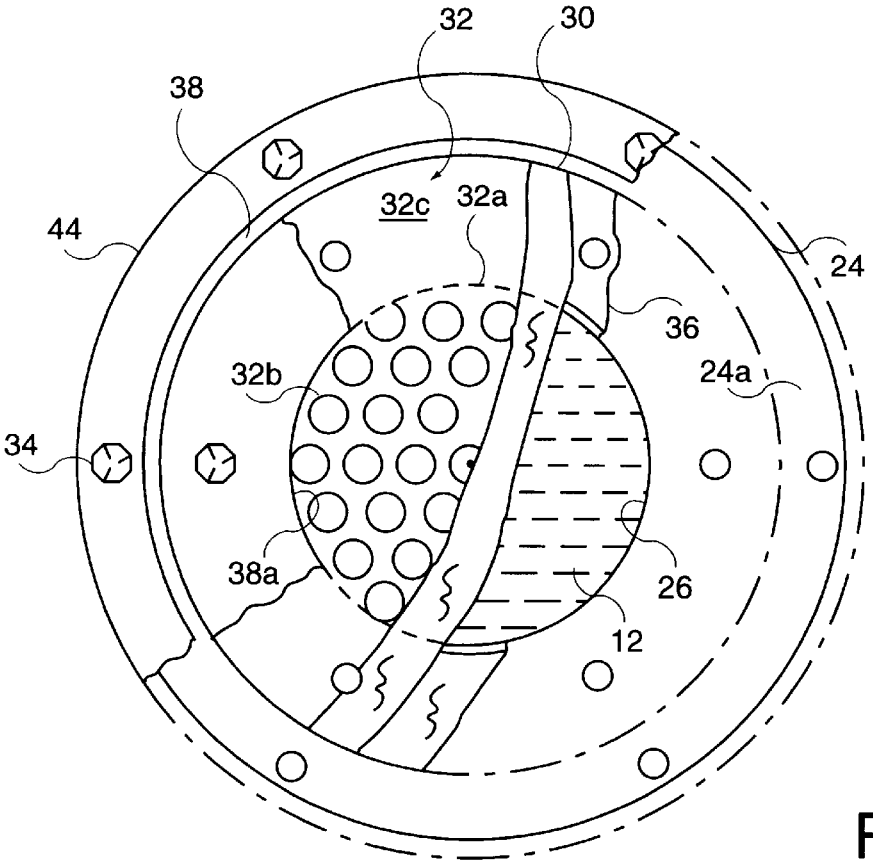
FIG. 4 is a partly layered front view of the target illustrated in FIG. 2 and taken along plane 4—4.

The grid 32 supporting the foil 30 is illustrated in more particularity in FIGS. 3 and 4 in accordance with an exemplary embodiment. The grid 32 is in the form of a disk having a perforate center core 32*a* for supporting the front side of the foil 30. The center core 32 has a plurality of apertures 32*b* in the form of a relatively close packed array of circular holes through which the particle beam 20 may pass, with the remaining ribs therebetween abutting the foil 30 for reacting the pressure forces in the irradiated sample 12.

An annular rim 32*c* integrally surrounds the center core 32*a* and is fixedly joined to the body front side for conducting heat thereto. The grid 32 may be formed of any suitable material such as aluminum for its strength and heat conducting capability.

In order to seal the thin foil 30 against the body 24 and provide additional support therefor, a gasket sheet 36 is disposed between the backside of the foil 30 and the front side of the body, and has a central aperture aligned with the depression 26. The sheet 36 is preferably thin and may be formed of polyethylene of about 0.1 mm thickness.

A retaining ring 38 abuts the front side of the grid rim 32*c* and has a central aperture 38*a* which surrounds the grid core 32*a* for allowing the particle beam 20 to pass thereto. The foil 30, grid 32, gasket sheet 36, and retaining ring 38 preferably have a common outer diameter so that the bolts 34 may extend axially therethrough for clamping together these components against the front side of the body 24. This clamping arrangement seals the foil 30 to the body 24, provides physical support therefor on its front and back sides, and provides an effective heat dissipation path into the body. The retaining ring 38 may be formed of a suitable heat conductor such as aluminum and is relatively thick, for example 9.5 mm, for providing an effective heat sink from the grid 32.

In accordance with another advantage of the present invention, the depression 26 illustrated in FIG. 3 is preferably very shallow in depth for allowing the particle beam to irradiate substantially all the sample 12 therein to produce the radioisotope. For the exemplary oxygen-18 enriched water sample 12 contained in the depression 26, the depression may be as shallow as about 1.7 mm for providing an effective nuclear cross section for irradiation by the particle beam. Correspondingly, the grid 32 is also very thin with a thickness equal to about the depression depth for providing foil support and heat conduction from the foil to the body. The depth of the depression 26 and thickness of the grid 32 may be in the exemplary range of 1 to 2 mm.

As illustrated in FIG. 2, irradiation of the sample 12 by the particle beam 20 generates significant heat which must be suitably dissipated to prevent damage to the target as well as to the thin foil 30, as well as protecting the produced radioisotope. Since the depression 26 is very shallow, the amount of heat input into the sample 12 is thereby limited. And, such heat is conducted away from the depression 26 rearwardly through the body 24 as well as forwardly and laterally through the foil 30 and grid 32 in a circuitous path back into the front side of the body 24.

Figure 5:
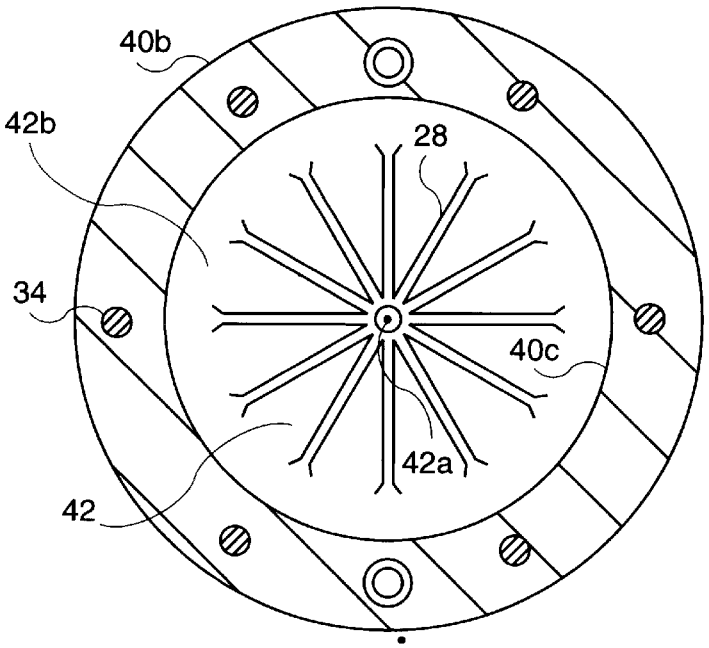
FIG. 5 is a partly sectional back view of the target illustrated in FIG. 2 and taken along plane 5—5.

As initially illustrated in FIG. 1, suitable means 40 are provided for circulating a coolant 40*a* over the cooling fins 28 to cool the body 24 during particle beam irradiation of the sample to remove heat from the target. Portions of the cooling means 40 are illustrated in more particularity in an exemplary embodiment in FIG. 2 and include a hood or housing 40*b* fixedly joined to the backside of the body 24 by additional ones of the bolts 34 as illustrated in FIG. 5. The housing 40*b* is tubular to match the disk body 24 and defines a plenum 40*c* surrounding the cooling fins 28.

In accordance with another feature of the present invention, the body 24 further includes an integral solid cone 42 as illustrated in FIGS. 2 and 5 which extends outwardly from the backside 24*b* of the body 24 behind the depression 26 and inside the surrounding plenum 40*c*. The cooling fins 28 are integrally disposed on the outer surface of the cone 42 for cooperating therewith to increase the available surface area for transferring heat from the body 24 to the coolant 40*a* during operation.

The cone 42 includes a central apex 42*a* and an opposite annular base 42*b*, and may have any suitable contour therebetween from straight to curved as illustrated in FIG. 2. The cooling fins 28 are circumferentially spaced apart around the outer surface of the cone 42 and extend axially between the apex 42*a* and the base 42*b* in any suitable configuration for maximizing heat extraction from the body 24. The individual cooling fins 28 may be simply formed by casting or machining corresponding grooves in the outer surface of the cone 42 with the remaining lands therebetween defining the fins 28. Alternatively, the fins 28 may be suitably attached to the outer surface of the cone 42.

In the exemplary embodiment illustrated in FIGS. 2 and 5, the cooling fins 28 are axially straight from the apex to the base of the cone. Alternatively, cooling fins 28 may spiral.

As shown in FIG. 2, a single center inlet 40*d* and a pair of outlets 40*e* are disposed in the back wall of the housing 40*b* in flow communication with the plenum 40*c*. The housing inlet 40*d* is preferably coaxially aligned with the cone apex 42*a*, and the outlets 40*e* are spaced radially outwardly therefrom for cooperating with the cone 42 for circulating the coolant 40*a* through the plenum 40*c* to remove heat from the body 24. The inlet and outlets 40*d,e* may be defined by threaded fittings attached to corresponding conduits which circulate the coolant 40*a* through the plenum 40*c*. The remainder of the cooling means 40 may have any conventional configuration including a coolant reservoir, circulating pump, and heat exchanger for removing heat from the coolant.

The resulting target 14 illustrated in FIG. 2 is a compact assembly of elements cooperating together for improving the irradiation efficiency of the sample 12, while effectively removing heat from the body 24 during operation. The target 14 may also include a tubular or cup-shaped mounting flange 44 which closely surrounds the body 24 and has a central aperture within which the retaining ring 28 is disposed. The mounting flange 44 may be made of any suitable material, such as aluminum, and fastened to the body front side 24*a* using additional ones of the bolts 34 as illustrated in FIGS. 2 and 4.

The mounting flange 44 is sized in outer diameter to fit closely within the inner bore of a tubular holder 46 mounted to the accelerator housing 22 for allowing simple assembly and disassembly of the target 14 in the system.

Although the sample 12 may be manually placed in the depression 26, this requires disassembly and reassembly of the target 14. However, to eliminate the need to disassemble the target 14 to replenish the sample 12, conventional means designated by the prefix 48 are provided for sequentially supplying the sample 12 into the depression 26 for irradiation, and in turn removing the radioisotope 16 generated thereafter. The sample supplying means 48 includes a delivery conduit 48*a* comprising an inlet tube extending through the wall of the housing 40*b* to a cooperating inlet bore extending through the body 24 to one side of the depression 26.

A return conduit 48*b* comprises an outlet bore through the body 24 from an opposite end of the depression 26 to a cooperating outlet tube also extending through the wall of the housing 40*b*. The sample 12 in liquid form is injected through the delivery conduit 48*a* into the depression 26 for irradiation, with the resulting radioisotope 16 being purged from the depression 26 by injecting a suitable inert gas, such as Helium, through the delivery conduit 48*a*. In this way batches of samples 12 may be delivered in turn to the depression 26 and irradiated for returning the radioisotope in corresponding batches.

The resulting target 14 allows the use of low energy, high current particle beams for effectively producing radioisotopes with extremely thin foil windows which are not damaged or ruptured due to the high pressure generated during irradiation. The corresponding reduction in cost of the target 14 itself, as well as the irradiation system 10 therefor, improves the economy of practicing Positron Emission Tomography.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A target for irradiation of a sample by a particle beam to produce a radioisotope comprising:

a body having a depression in a front side for holding said sample, and cooling fins on a backside opposite said depression;

a foil sealingly joined to said body front side to cover said depression;

a perforate grid fixedly joined to said body atop said foil for supporting said foil, and for transmitting said particle beam therethrough; and means for circulating a coolant over said fins to cool said body during said particle beam irradiation of said sample in said depression.

2. A target according to claim 1 wherein said body further includes a cone extending from said backside behind said depression, and said fins are disposed on said cone.

3. A target according to claim 2 wherein said cooling means comprise:

a housing joined to said body around said cone to define a plenum therebetween; and an inlet and outlet disposed in said housing in flow communication with said plenum for circulating said coolant therethrough to remove heat from said body.

4. A target according to claim 3 wherein said cone includes an apex and an opposite base, and said fins are circumferentially spaced apart around said cone and extend axially between said apex and base.

5. A target according to claim 4 wherein said fins are axially straight.

6. A target according to claim 4 wherein said housing inlet is coaxially aligned with said cone apex, and said outlet is spaced radially outwardly therefrom.

7. A target according to claim 3 wherein said grid comprises a disk having a perforate center core for supporting said foil, and a surrounding rim fixedly joined to said body front side for conducting heat thereto.

8. A target according to claim 7 wherein:

said depression is shallow in depth for allowing said particle beam to irradiate substantially all said sample therein to produce said radioisotope; and said grid is thin with a thickness of about said depression depth for conducting heat from said foil to said body.

9. A target according to claim 7 further comprising a retaining ring fixedly joined to said body to clamp said grid rim thereagainst, and having a central aperture surrounding said grid core.

10. A target according to claim 3 wherein said foil is aluminum and about six microns thin.

* * * * *